United States Patent [19]

Brix

[11] 4,018,181

[45] * Apr. 19, 1977

[54] LATERAL THRUST CONTROL UNIT FOR WATERCRAFTS

[75] Inventor: Jochim Brix, Hamburg, Germany

[73] Assignee: Schottel-Werft Josef Becker KG, Apay am Rhine, Germany

[ * ] Notice: The portion of the term of this patent subsequent to Sept. 9, 1992, has been disclaimed.

[22] Filed: Mar. 28, 1975

[21] Appl. No.: 563,211

[30] Foreign Application Priority Data

May 14, 1974 Germany ..... 2423468

[52] U.S. Cl. ..... 114/151

[51] Int. Cl.[2] ..... B63H 25/46

[58] Field of Search ..... 114/144 R, 148, 150, 114/151; 115/11, 12 R, 35 R, 50, 67 R, 67 A

[56] References Cited

UNITED STATES PATENTS 1,163,352 12/1915 Linscott ..... 114/148

FOREIGN PATENTS OR APPLICATIONS 890,399 2/1962 United Kingdom ..... 114/151

*Primary Examiner*—Trygve M. Blix
*Assistant Examiner*—Jesus D. Sotelo
*Attorney, Agent, or Firm*—Woodhams, Blanchard and Flynn

[57] ABSTRACT

A lateral thrust control unit for watercrafts having a pair of tunnels which are directed transversely to the longitudinal axis thereof. Each of the tunnels extend from one side of the watercraft to the oppositely positioned side of the watercraft and have at least one drivable propeller therein. At least one pressure-compensating channel is provided near the tunnels and connects at least one of the zones of differing pressure fields created on the sidewalls of the watercraft as the watercraft moves simultaneously longitudinally and laterally to the pressure field of different potential to equalize the pressure differential therebetween and to reduce the resistance to the lateral movement. The pressure-compensating channels do not have any propulsion devices therein.

14 Claims, 4 Drawing Figures

LATERAL THRUST CONTROL UNIT FOR WATERCRAFTS

FIELD OF THE INVENTION

The invention relates to a lateral thrust control unit for watercrafts.

BACKGROUND OF THE INVENTION

The purpose of the lateral thrust control unit is to apply a lateral force onto the ship through the thrust-producing device, mostly a propeller, which is provided in the tunnels which are arranged transversely to the longitudinal axis of the watercraft, to thus increase the maneuverability of the watercraft. I have found that during a longitudinal and simultaneous lateral movement of the ship, an underpressure field is created on one wall of the ship and an overpressure field is created on the other wall of the ship, which pressure fields are directed opposite to the lateral thrust and which reduce the effect of the lateral thrust control unit.

For this reason, I have already suggested means in U.S. Pat. application Ser. No. 380,667, filed July 19, 1973, which means diminish the interfering pressure fields. These means consist of at least one pressure-compensating channel, which also extends from one sidewall of the watercraft to the other one and connects the areas of the opposite potentials. It is thereby of less importance whether or not the pressure-compensating channel or the pressure-compensating channels extend indeed from one sidewall of the watercraft to the other sidewall and open outwardly near the tunnel openings, even though this arrangement has been proven to be practically the most effective one. Instead, it is the diminishing of the pressure fields that is the most important. Moreoever, a pressure-compensating channel effects a smaller water jet deflection of the exiting jet of water and an additional impulse through the present passive flow, which has the same direction as the jet of water from the lateral thrust control unit. Thus, it is possible to provide, for example, one or several channels which connect the interfering pressure fields to a different area of opposite and lesser potential. Also, in principle, it does not matter which shape these pressure-compensating channels have.

The lateral thrust units can be provided in front or astern or several times, for example, in front and astern or in a different suitable manner on the watercraft.

The purpose of the invention is to construct the abovediscussed lateral thrust control units more effectively, in particular to concentrate the required structure in the available space, in particular for watercraft having a draught limitation which would bring about the danger of air being sucked into the tunnel when large diameters are used for the lateral thrust control unit. Individual units having a high output require the use of high voltage, which is not available in many cases or does not appear advantageous for various reaasons. Also, it may be that the use of high voltage is not desired.

The basic purpose of the invention is achieved by providing a lateral thrust control unit which includes a pair of tunnels having propulsion means therein. The units can thereby be used together or individually in both directions of travel. It is also possible to use the one tunnel of the pair as a stand-by unit in case of a failure of the waterdrive unit in the other tunnel. In this connection it must again be pointed out that the shape and path of the compensating channels is not important. Instead, the diminishing of the damaging pressure fields is the most important.

An effective double unit is obtained when closure devices for the compensating channels are remote controlled in a known manner. Of course, it is also possible to have closure devices for all tunnel and channel mouths which would be closable to, for example, reduce the watercraft's resistance during normal forward or backward travel.

A compact construction is obtained by locating the tunnels closely together.

When space is of a premium in the watercraft and costs are also a factor, the compensating channel or channels can be positioned between the tunnels and be free of any associated closure device and, as a result, would function independent of the direction of travel of the watercraft because the tunnel which is the frontmost one would be normally utilized while the tunnel which lies therebehind can be used either as an additional output or can serve as a stand-by unit.

Further advantages and characteristics of the invention result from the following description.

BRIEF DESCRIPTION OF THE DRAWINGS

The invention will be discussed in connection with the exemplary embodiments illustrated in FIGS. 1 to 4.

In the drawings:

FIGS. 1 and 2 do not indicate any size relationships with respect to the watercraft;

DETAILED DESCRIPTION

Figure 1:
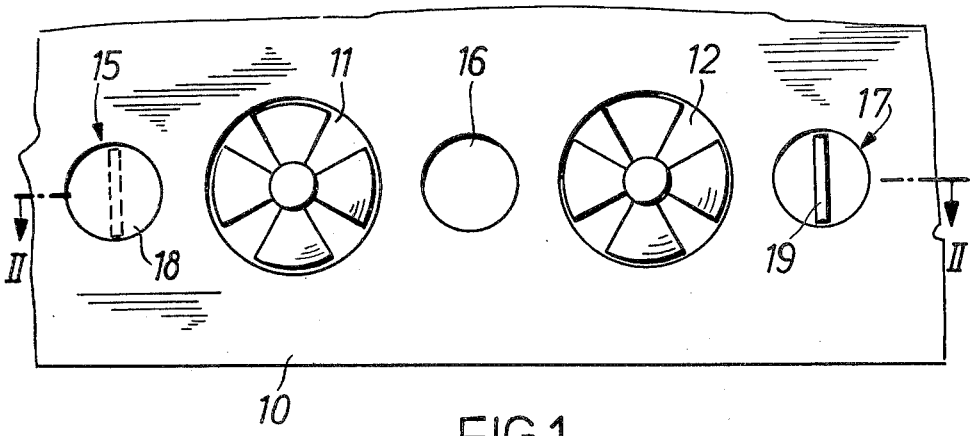
FIG. 1 schematically illustrates a fragmentary section of a hull of a watercraft having a lateral thrust control unit according to the invention.
Figure 2:
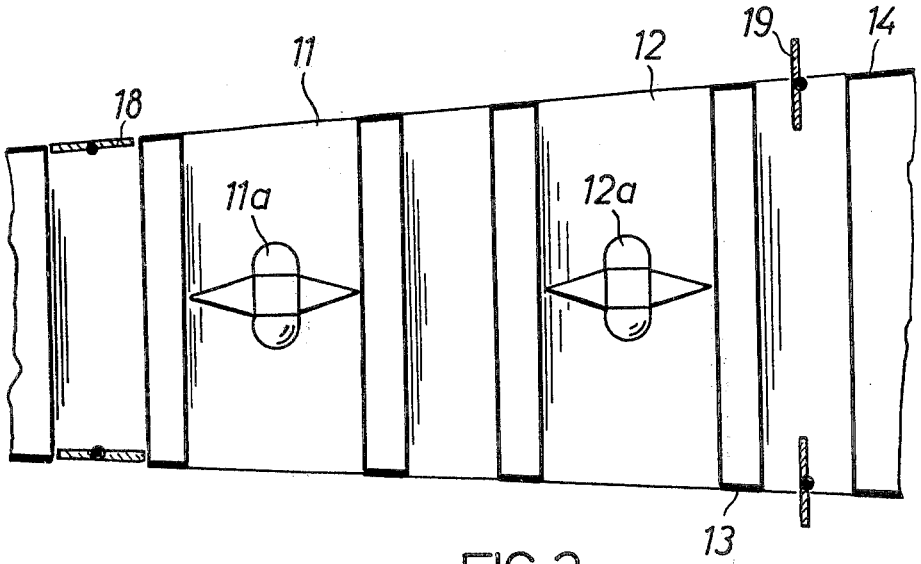
FIG. 2 is a cross-sectional view taken along the line II—II of FIG. 1.

In a watercraft 10, of which a section is shown in FIGS. 1 and 2, a pair of tunnels 11,12 are arranged transversely to the longitudinal axis of the watercraft and provide water communication from one wall 13 of the hull to the opposite wall 14 thereof. A single thrust-producing device, here reversible drivable propellers **11*a*,12*a*, is provided in each of the tunnels. The tunnel openings can be closable and/or can be rounded or sloped into the outside wall structure of the watercraft. The closure devices are not illustrated. The watercraft can be driven either forward or backward. However, and independent of the direction of travel of the watercraft, an overpressure field is created at the inlet end of the tunnel and an underpressure field is created at the outlet end of the tunnel, both of which act against the lateral thrust provided by the drivable propellers. The locations and the form of the pressure fields depend on the overall shape of the watercraft. A pressure-compensating channel, here three channels 15, 16, 17, is provided in front of, behind and between the tunnels 11,12, namely at the locations which are most advantageous to equalize the differences in the pressures in the pressure fields. In this particular embodiment, the channels 15, 16, 17 open outward of the hull and extend between walls 13 and 14 of the hull. There is no drivable propeller in any of the channels 15, 16 and 17. Each pressure-compensating channel can, if desired, be replaced by a plurality of side-by-side channels. The cross-sectional shape of each of the channels 15, 16** and 17 depends on the shape and location of the pressure fields. The two outer channels 15 and 17 each have a remote-controllable closure device 18 and 19, respectively, which depending on the requirements of the watercraft, may also have a design which is different than the one shown in the drawings. The pressure-compensating channel 15 or 17 which, depending on the direction of travel, is positioned astern and is opened upon operation of the lateral thrust control unit.

Figure 3:
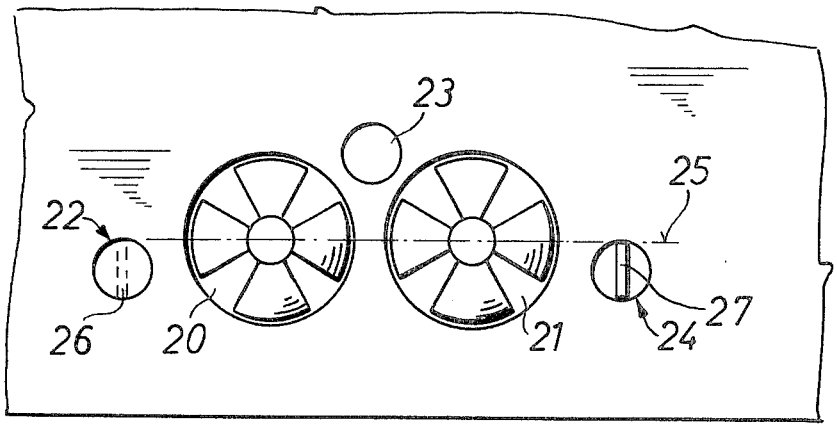
FIG. 3 is schematically illustrates a different exemplary embodiment of the invention.

FIG. 3 illustrates a lateral thrust control unit in which the thrust-producing tunnels 20,21 are arranged in closely positioned pairs. The pressure-compensating channels 22, 23 and 24 are, therefore, located above and below of the horizontal centerline 25 extending through both of the centers of the tunnels 20 and 21. The central axis of the pressure compensating channel 22 is contained in a theoretical plane transverse of the plane containing the horizontal centerline 25 which plane intersects the centerline 25 between the central axes for the tunnels 20 and 21. The respective outer pressure-compensating channels 22 and 24 are provided with closure devices 16 and 17. Of course, it is also possible to arrange the pressure-compensating channels on both the upper and lower sides of the centerline 25. If the tunnels are not extremely close together, the center channel 23 may also have a slot-shaped construction and may lie symmetrically with respect to the centerline 25 between the tunnels 20 and 21.

Figure 4:
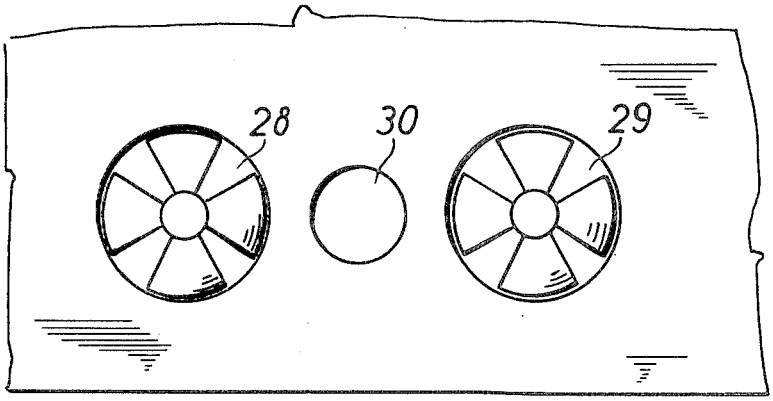
FIG. 4 illustrates a further exemplary embodiment.

FIG. 4 illustrates a lateral thrust control unit, which, when judging the effect and the investment, can be considered to be particularly advantageous. The two thrustproducing tunnels 28 and 29 are so far apart that between them can be arranged a pressure-compensating channel 30 having an optimum action for both directions of travel. The outer pressure-compensating channels, which would have to be provided with closure devices, are not provided in this embodiment. The center channel takes care of the pressure-compensation for the tunnel which, depending on the direction of travel, is positioned in front of the tunnel, while the tunnel which is positioned rearwardly therefrom operates without pressure-compensation. From the standpoint of pressure-compensation, this construction is not quite as effective as, for example, the one according to FIG. 1, however, if one considers the input of investment and needed space, then the construction according to FIG. 4 results in a very advantageous solution. The central axis for the channel 30 (FIG. 4) and the channel 16 (FIG. 1) are both contained in a theoretical plane transverse of the horizontal centerline for the tunnels 28,29 and 11,12, respectively, however are also located on the horizontal centerline.

Although particular preferred embodiments of the invention have been disclosed in detail for illustrative purposes, it will be recognized that variations or modifications of the disclosed apparatus, including the rearrangement of parts, lie within the scope of the present invention. The underpressure field on the jet entrance side is created by a twin vortex behind the deflected jet. The opposite overpressure field is due to the delay of flow velocity behind the jet entrance side.

The embodiments of the invention in which an exclusive property or privilege is claimed are defined as follows:

1. A lateral thrust control unit for the hull of a watercraft, comprising:

means defining a pair of tunnels which extend transversely to the longitudinal axis of said watercraft and generally between the sidewalls of said watercraft and have propulsion means therein;

means defining zones of differing pressure fields created on the sidewalls of said hull of said watercraft during a longitudinal and simultaneous lateral movement of said watercraft to resist the lateral movement of said watercraft, said zones being positioned longitudinally along said sidewalls of said hull from said pair of tunnels; and pressure-compensating channel means for connecting at least one of said zones of differing pressure fields to a pressure field of different potential to equalize the pressure differential therebetween and to reduce the resistance to said lateral movement, said pressure-compensating channel means being free of propulsion means therein.

2. A lateral thrust control unit for the hull structure of a watercraft, comprising:

means defining a pair of tunnels in at least one of the bow and stern of said hull structure and which are directed transversely to the longitudinal axis of said watercraft, extend generally between the sidewalls of said watercraft and have propulsion means therein, said pair of tunnels having an inlet and an outlet integral with said hull and opening outwardly at the sidewalls thereof;

means defining zones of underpressure and overpressure created on the sidewalls of said one of said bow and stern of said hull of said watercraft during a longitudinal and simultaneous lateral movement of said watercraft to resist the lateral movement of said watercraft, said zones being positioned longitudinally along said sidewalls of said one of said bow and stern of said hull structure from said pair of tunnels; and means defining at least one pressure-compensating channel positioned adjacent said pair of tunnels and spaced longitudinally along one of said bow and said stern of said hull structure of said watercraft from said pair of tunnels, said pressure-compensating channel means having an inlet and an outlet integral with and opening outwardly of the sidewalls of said hull at said zones of underpressure and overpressure created on said sidewalls of said watercraft during said longitudinal and simultaneous lateral movement of said watercraft and providing fluid communication between said zones of underpressure and overpressure to equalize the pressure differential therebetween and to reduce the resistance to said lateral movement, said pressure-compensating channel means being free of propulsion means therein.

3. A lateral thrust control unit for the hull of a watercraft, comprising:

means defining a pair of tunnels extending through said hull of said watercraft, the axis of said pair of tunnels being directed transversely to the longitudinal axis of said watercraft, said pair of tunnels extending from one side of said watercraft to the opposite side thereof and each has propulsion means therein, each of said pair of tunnels having an inlet and an outlet integral with said hull and opening outwardly at the sidewalls thereof;

means defining zones of underpressure and overpressure created on the sidewalls of said hull of said watercraft during a longitudinal and simultaneous lateral movement of said watercraft to resist the lateral movement of said watercraft, said zones being positioned longitudinally along said sidewalls of said hull from said pair of tunnels; and means defining at least one pressure-compensating channel adjacent to and separate at all times from fluid communication with said pair of tunnels and extending continuously and without interruption from one side of said watercraft to the opposite side thereof, said pressure-compensating channel means having an inlet and an outlet integral with and opening outwardly of the sides of said hull of said watercraft at said zones of underpressure and overpressure created on said sidewalls of said hull of said watercraft during a longitudinal and simultaneous lateral movement of said watercraft and providing an uninterrupted fluid communication between said zones of underpressure and overpressure to equalize the pressure differential therebetween and to reduce the resistance to said lateral movement, said pressure-compensating channel means being free at all times of propulsion means therein.

4. A lateral thrust conrol unit for the hull of a watercraft, comprising:

means defining a pair of tunnels through said hull and which are directed transversely to the longitudinal axis of said watercraft, extend generally between the sidewalls of said watercraft and have propulsion means therein;

means defining zones of differing pressure fields created on the sidewalls of said hull of said watercraft during a longitudinal and simultaneous lateral movement of said watercraft to resist the lateral movement of said watercraft, said zones being positioned longitudinally along said sidewalls of said hull from said pair of tunnels; and pressure-compensating channel means in said hull, at least one end thereof opening outwardly of said sidewall of said hull at a location whereat the axis thereof is located in a theoretical plane transverse of a plane containing the axes of said pair of tunnels, which plane intersects said theoretical plane at a location between said axes of said pair of tunnels for connecting at least one of said zones of differing pressure fields to a pressure field of different potential to equalize the pressure differential therebetween and to reduce the resistance of said lateral movement, said pressure-compensating channel means being free of propulsion means therein.

5. A lateral thrust control according to claim 4, wherein said axis of said pressure-compensating channel means is located in said plane containing the axes of said tunnels.

6. A lateral thrust control according to claim 4, wherein said axis of said pressure-compensating channel means is equidistant from the axes of said pair of tunnels.

7. A lateral thrust control according to claim 4, wherein said pressure-compensating channel means is free at all times of closure means.

8. A lateral thrust control according to claim 4, including a pair of additional pressure-compensating channel means, one of said additional pressure-compensating channel means being located on the bow side of said watercraft from said pair of tunnels, the other of said additional pressure-compensating channel means being located on the stern side of said pair of tunnels.

9. A lateral thrust control according to claim 8, wherein the axes of said pressure-compensating channel means and said additional pair of pressure-compensating channel means are contained in said plane containing the axes of said pair of tunnels.

10. A lateral thrust control according to claim 8, wherein the axis of said pressure-compensating channel means is equidistant from the axes of said additional pair of pressure-compensating channel means.

11. A lateral thrust control according to claim 10, wherein said axis of said pressure-compensating channel means is located on one side of said plane containing the axes of said pair of tunnels; and wherein said axes of said pair of pressure-compensating channel means are both located on the opposite sides of said plane.

12. A lateral thrust control according to claim 8, wherein said pressure-compensating channel means is free at all times of closure means; and wherein said pair of additional pressure-compensating channel means both include means for controlling the flow of water therethrough.

13. A lateral thrust control unit for the hull structure of a watercraft, comprising:

means defining a pair of tunnels in at least one of the bow and stern of said hull structure and which are directed transversely to the longitudinal axis of said watercraft, extend generally between the sidewalls of said watercraft and have propulsion means therein, said propulsion means including propeller means in each of said tunnels, said pair of tunnels having an inlet and an outlet integral with said hull and opening outwardly at the sidewalls thereof;

means defining zones of underpressure and overpressure created on the sidewalls of said one of said bow and stern of said hull of said watercraft during a longitudinal and simultaneous lateral movement of said watercraft to resist the lateral movement of said watercraft, said zones being positioned longitudinally along said sidewalls of said one of said bow and stern of said hull structure from said pair of tunnels; and means defining at least one pressure-compensating channel opening outwardly of said hull at one end thereof at least at a location adjacent said pair of tunnels and spaced longitudinally along one of said bow and said stern of said hull structure of said watercraft from said pair of tunnels and having an axis located in a theoretical plane transverse of a plane containing the axes of said pair of tunnels, which plane intersects said theoretical plane at a location between said axes of said pair of tunnels, said pressure-compensating channel means having an inlet and an outlet integral with and opening outwardly of the sidewalls of said hull at said zones of underpressure and overpressure created on said sidewalls of said watercraft during said longitudinal and simultaneous lateral movement of said watercraft and providing fluid communication between said zones of underpressure and overpressure to equalize the pressure differential therebetween and to reduce the resistance to said lateral movement, said pressure-compensating channel means being free of propulsion means therein.

14. A lateral thrust control unit for the hull of a watercraft, comprising:

means defining a pair of tunnels extending through said hull of said watercrft, the axis of said pair of tunnels being directed transversely to the longitudinal axis of said watercraft, said pair of tunnels extending from one side of said watercraft to the opposite side thereof and each has propulsion means therein, each of said pair of tunnels having an inlet and an outlet integral with said hull and opening outwardly at the sidewalls thereof;

means defining zones of underpressure and overpressure created on the sidewalls of said hull of said watercraft during a longitudinal and simultaneous lateral movement of said watercraft to resist the lateral movement of said watercraft, said zones being positioned longitudinally along said sidewalls of said hull from said pair of tunnels; and means defining at least one pressure-compensating channel adjacent to and separate at all times from fluid communication with said pair of tunnels and having an axis located in a theoretical plane transverse of a plane containing the axes of said pair of tunnels and located between said axes of said pair of tunnels, said pressure-compensating channel means extending continuously and without interruption from one side of said watercraft to the opposite side thereof, said pressure-compensating channel means having an inlet and an outlet integral with and opening outwardly of the sides of said hull of said watercraft at said zones of underpressure and overpressure created on said sidewalls of said hull of said watercraft during a longitudinal and simultaneous lateral movement of said watercraft and providing an uninterrupted fluid communication between said zones of underpressure and overpressure to equalize the pressure differential therebetween and to reduce the resistance to said lateral movement, said pressure-compensating channel means being free at all times of propulsion means therein.

* * * * *